US009080398B2

(12) United States Patent
Bouligny et al.

(10) Patent No.: US 9,080,398 B2
(45) Date of Patent: Jul. 14, 2015

(54) WELLBORE TUBULAR RUNNING DEVICES, SYSTEMS AND METHODS

(75) Inventors: Vernon J. Bouligny, New Iberia, LA (US); Mark S. Sibille, Lafayette, LA (US); Charles M. Webre, Lafayette, LA (US)

(73) Assignee: Frank's International, LLC, Houston, TX (US)

( * ) Notice: Subject to any disclaimer, the term of this patent is extended or adjusted under 35 U.S.C. 154(b) by 771 days.

(21) Appl. No.: 13/334,836

(22) Filed: Dec. 22, 2011

(65) Prior Publication Data

US 2012/0160517 A1 Jun. 28, 2012

Related U.S. Application Data

(60) Provisional application No. 61/427,109, filed on Dec. 23, 2010.

(51) Int. Cl.

| | |
|---|---|
| ***E21B 19/16*** | (2006.01) |
| ***E21B 3/02*** | (2006.01) |
| ***E21B 19/06*** | (2006.01) |
| ***E21B 19/15*** | (2006.01) |
| ***E21B 21/02*** | (2006.01) |

(52) U.S. Cl.

CPC . *E21B 19/16* (2013.01); *E21B 3/02* (2013.01); *E21B 19/06* (2013.01); *E21B 19/155* (2013.01); *E21B 19/165* (2013.01); *E21B 21/02* (2013.01)

(58) Field of Classification Search

CPC ..... E21B 19/06; E21B 19/155; E21B 19/16; E21B 19/165; E21B 21/02; E21B 3/02

USPC ..... 166/380, 250.01, 77.1, 77.51, 85.1, 66

See application file for complete search history.

(56) References Cited

U.S. PATENT DOCUMENTS

| | | | | |
|---|---|---|---|---|
| 5,909,768 | A | 6/1999 | Castille et al. | |
| 6,309,002 | B1 | 10/2001 | Bouligny | |
| 6,742,596 | B2 * | 6/2004 | Haugen | 166/380 |
| 7,281,587 | B2 | 10/2007 | Haugen | |
| 8,136,603 | B2 * | 3/2012 | Schneider | 166/380 |

(Continued)

OTHER PUBLICATIONS

TESCO, TesTork Wireless Torque/Turn Monitoring System, Bulletin 42000e, casingrunning.com.

(Continued)

*Primary Examiner* — Nicole Coy
(74) *Attorney, Agent, or Firm* — Winstead PC

(57) ABSTRACT

According to one or more aspects of the invention, a method for use with assembling and disassembling a tubular string formed by a first tubular and a second tubular may comprise engaging the first tubular with a first device; engaging the second tubular with a second device; connecting the first tubular to the second tubular by applying torque to the first tubular; determining a true torque applied in connecting the first tubular and the second tubular; ensuring that at least the first device or the second device is engaging the tubular string; disengaging the second device from the tubular string; and lowering the tubular string. The first device may be a top drive and the second device may be a spider. The top drive may comprise a tubular running tool. The top drive may comprise a tubular running tool and an elevator.

24 Claims, 7 Drawing Sheets

(56) References Cited

U.S. PATENT DOCUMENTS

| | | | | |
|---|---|---|---|---|
| 2007/0251701 | A1 | 11/2007 | Jahn et al. | |
| 2008/0060818 | A1 | 3/2008 | Bourgeois et al. | |
| 2009/0014169 | A1 | 1/2009 | Bouligny et al. | |
| 2009/0151934 | A1 * | 6/2009 | Heidecke et al. | 166/250.01 |
| 2009/0314496 | A1 | 12/2009 | Begnaud et al. | |

OTHER PUBLICATIONS

Weatherford International Ltd., TorkDrive 750HD (Heavy-Duty) Casing Running and Drilling Tool, Brochure; weatherford.com.

Honeywell Sensotec, "Clamp on Rotary Torque Transducer," Model 9300, Bulletin, date unknown.

* cited by examiner

WELLBORE TUBULAR RUNNING DEVICES, SYSTEMS AND METHODS

RELATED APPLICATIONS

This application claims the benefit of U.S. provisional application No. 61/427,109 filed on 23 Dec. 2010.

BACKGROUND

The invention relates in general to wellbore operations and more particular to devices and methods for running wellbore tubulars. In the drilling and completion of wells, tubular strings are run into (and out of) the wellbore. The tubular strings may be formed of various pipe types, weights, and diameters depending on the operation performed. In addition to running tubular strings into and out of the wellbore, it is often desired to rotate the tubular string. For example, it may be desired to drill the wellbore using casing, e.g., with a drill bit on the distal end thereof. It is therefore a benefit to provide devices and methods facilitating one or more of gripping tubular, axially moving the tubular, and rotating the tubular.

BRIEF DESCRIPTION OF THE DRAWINGS

The invention is best understood from the following detailed description when read with the accompanying figures. It is emphasized that, in accordance with standard practice in the industry, various features are not drawn to scale. In fact, the dimensions of features may be arbitrarily increased or reduced for clarity of discussion.

DETAILED DESCRIPTION

Figure 1:
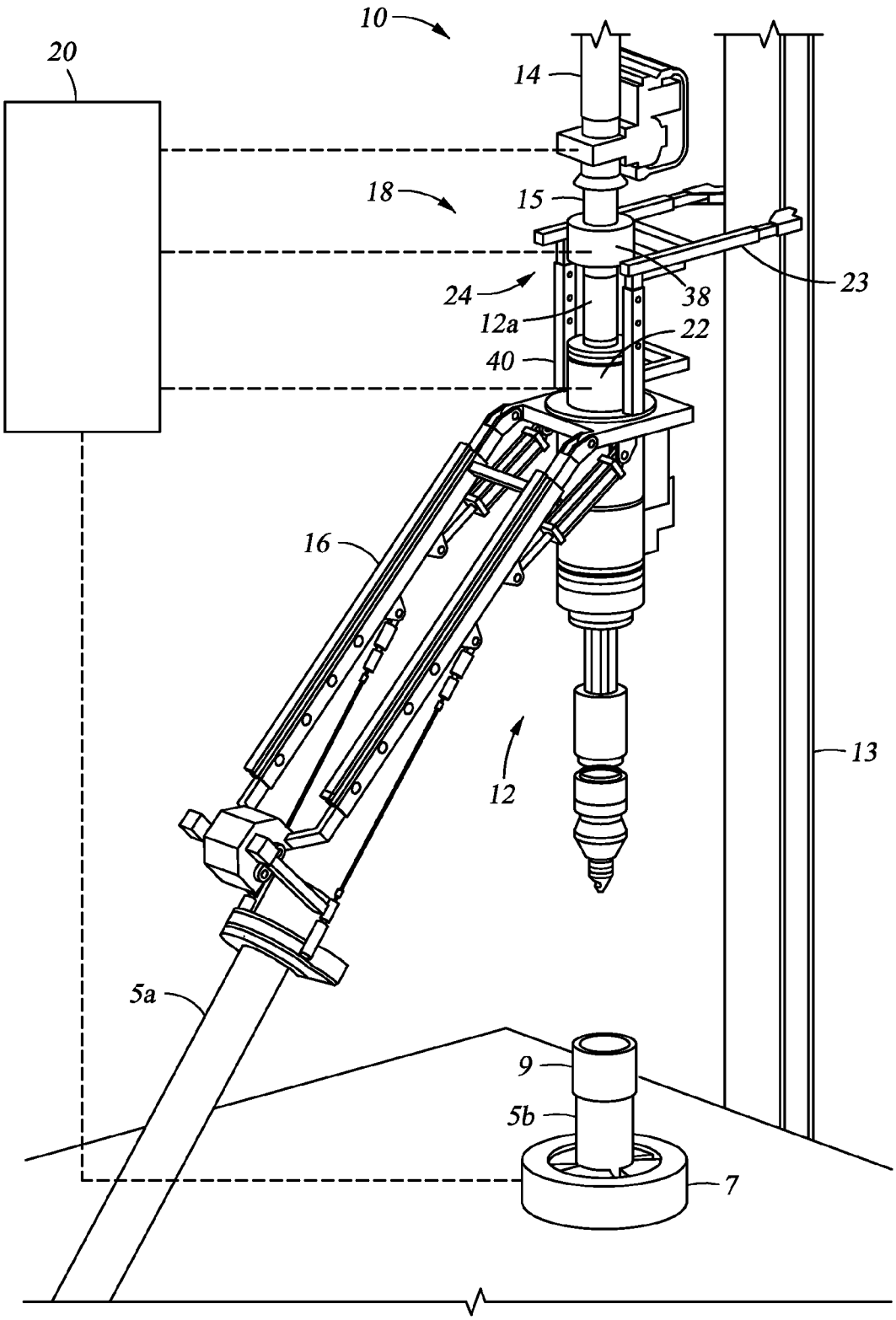
FIGS. 1 and 2 are a schematic elevation view of a tubular running system according to one or more aspects of the invention.

It is to be understood that the following description provides many different embodiments, or examples, for implementing different features of various embodiments of the invention. Specific examples of components and arrangements are described below to simplify the description. These are, of course, merely examples and are not intended to be limiting. In addition, the description may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Terms utilized herein to identify features of the invention are selected herein for the purpose of describing the depicted embodiments and are not utilized to convey functionality or limit the scope of the described feature merely by the identifying term utilized.

According to one or more aspects of the invention a device connectable in a wellbore tubular running system includes a sensor removably connected with a top drive capable of measuring torque applied from the top drive.

A wellbore tubular running system according to one or more aspects of the invention comprises a top drive operable to rotate a tubular; a tubular running tool connecting the top drive and the tubular; a first sensor connected to a tubular member capable of measuring a torque applied from the top drive to the tubular; and a load sensor connected with the tubular running tool capable of measuring a drag torque applied in response to the torque applied from the top drive.

According to one or more aspects of the invention a method for assembling and/or disassembling a tubular string formed of a first tubular and a second tubular comprises engaging the first tubular with a first device; engaging the second tubular with a second device; connecting the first tubular to the second tubular by applying torque to the first tubular; determining a torque applied in connecting the first tubular and the second tubular; ensuring that at least the first device or the second device is supporting the tubular string; disengaging the second device from the tubular string; and lowering the tubular string. Determining the torque applied can comprise measuring the torque applied to the first tubular; measuring a drag torque associated with the torque applied; and reducing the measured torque applied by the measured drag torque.

A method according to one or more aspects of the invention for assembling and/or disassembling a tubular string formed by a first tubular and a second tubular includes rotationally engaging the first tubular with a top drive; supporting the second tubular with a spider; connecting the first tubular to the second tubular by applying a torque from the top drive to the first tubular; connecting a sensor with the top drive; measuring an axial load with the sensor; ensuring that the tubular string is axially supported; disengaging the spider from the tubular string; and lowering the tubular string.

Figure 2:
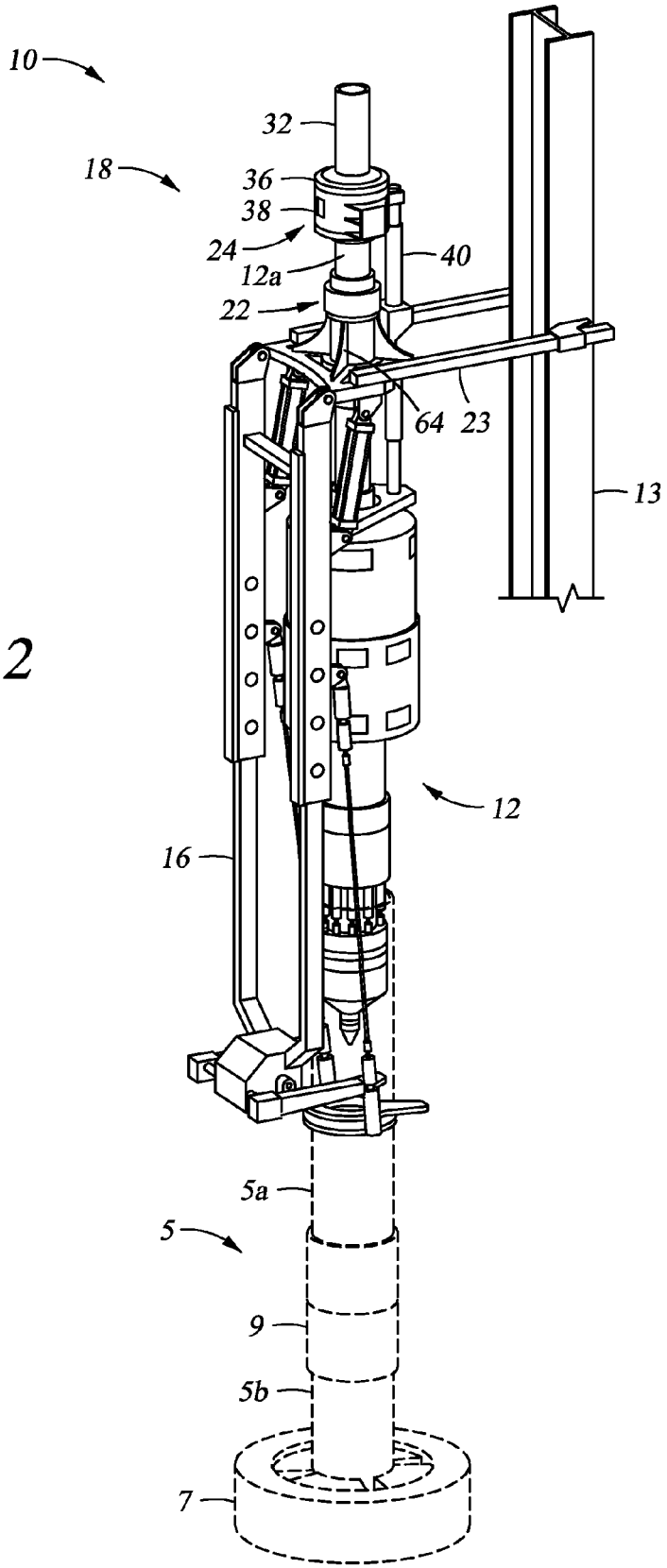

FIG. 1 and FIG. 2 are schematic views of a system 10, referred to herein as a tubular running system or tubular running interlock system, according to one or more aspects of the invention. System 10 may include a tubular running tool 12 connected to a top drive 14, e.g., to a rotatable top drive shaft 15 (e.g., quill) via the mandrel 12*a* of tubular running tool 12. Various types and configurations of running tools may be utilized, including internal and/or external gripping and/or supporting devices. Examples of some tubular running tools are disclosed in US 2009/0314496 and U.S. Pat. No. 6,309,002, each of which is incorporated herein by reference. System 10 may be utilized to rotate a tubular 5 (e.g., production tubing, casing, drill pipe, any oil country tubular good, etc.). Tubular 5 may refer to a single tubular joint (e.g., add-on tubular 5*a*), segment or two or more interconnected tubular joints or segments forming, for example, a tubular stand or a tubular string (e.g., tubular 5*b*). System 10 may be utilized, for example, to make up and/or break out a connection between an add-on tubular (e.g., tubular 5*a*) with another tubular (e.g., tubular string 5*b*) and/or to rotate the tubular string, for example, to drill or ream. Running tool 12 depicted in FIGS. 1 and 2 includes a tubular manipulator 16 (e.g., an elevator, single joint manipulator arm, etc.). One example of a tubular manipulator is described in US 2008/0060818, which is incorporated herein by reference.

The mandrel 12*a* of tool 12 is depicted in FIG. 1 connected to shaft 15 (e.g., quill) of top drive 14. System 10 includes a measurement system, generally denoted by the numeral 18. According to one or more aspects of the invention, measurement system 18 is adapted to acquire (e.g., measure, sense, detect, etc.) one or more parameters associated with running wellbore tubulars. Examples of parameters associated with running wellbore tubulars include, without limitation, torque applied, e.g., from top drive 14, revolutions (e.g., turns) of tubular 5, the rotational speed (e.g., rpm) of tubular 5, a reaction (e.g., drag) torque associated with the rotation and/or torque applied by top drive 14 and the axial load on tool 12 and/or top drive 14. System 10 according to one or more aspects of the invention may indicate whether tubular running tool 12, an elevator (e.g., manipulator 16), and/or a spider 7 is supporting the weight of tubular (e.g., tubular string) 5 for example via an axial load measurement. In one example, manipulator 16 may be interlocked closed as long as the axial load detects the weight of a single tubular joint for example on tool 12.

According to one or more aspects of the invention, system 10 includes a control system generally denoted by the numeral 20. Control system 20 may be in communication (e.g., electronic, e.g., wired or wireless, pneumatic, hydraulic) with various devices and sub-systems of tubular running system 10. Control system 20 may include, without limitation, electronic processors, displays, visual and/or auditory indicators, software, electrical power sources, pressurized fluid sources (e.g., pneumatic, hydraulic), electronic and/or pressurized fluid logic, electrical and/or fluid circuits, sensors, actuators and the like for operating tubular running system 10. An example of a control system is described in U.S. Pat. No. 5,909,768, which is incorporated herein by reference.

Measurement system 18 may include one or more devices provided in separate and/or combined assemblies as will be further understood with reference to the various figures. FIGS. 1 and 2 depict a reaction load device 22 and a torque sensor device 24 of measurement device 18. Reaction load device 22 is depicted in connection with an arrestor 23 which cooperates with a rotationally stationary object 13 (e.g., rig, top drive housing, top drive bail ear, cable, top drive rail, etc.) to arrest the rotation of one or more features of tool 12, for example, in response to the torque applied from top drive 14.

Torque sensor device 24 may acquire data, such as, but not limited to revolutions (e.g., number and or speed) of tubular 5 and/or the torque applied for example from top drive 14 to tubular 5. According to one or more aspects of the invention an actual or true torque applied, for example, at the threaded connection 9 (e.g., collar, pin and box ends) of tubular 5*a* and 5*b* may be determined utilizing, for example, torque data acquired from torque sensor device 24 and reaction load device 22. A reaction load device is described further with reference to FIGS. 6 and 7 below.

Figure 3:
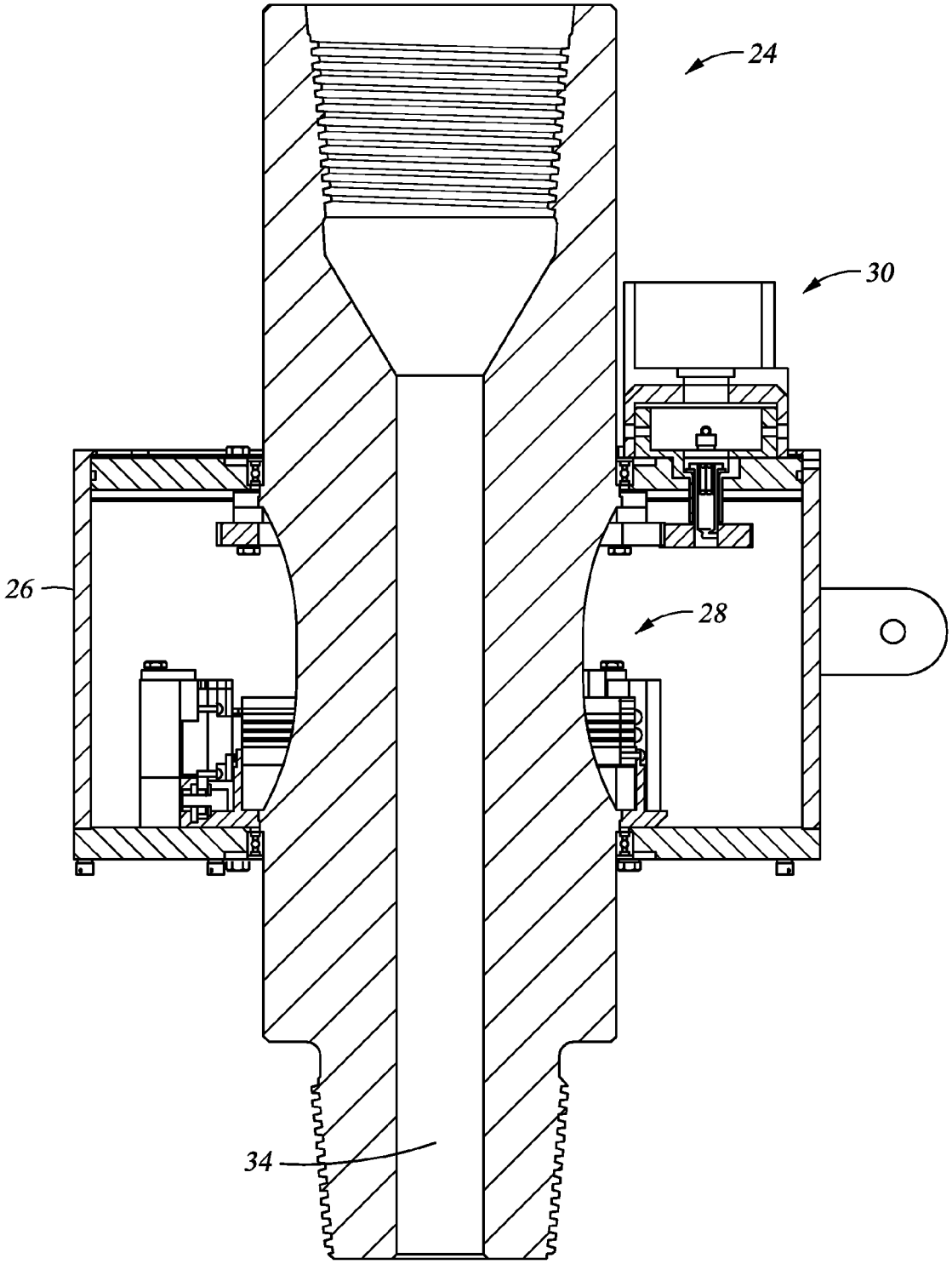
FIG. 3 is a schematic of a torque sensor device view of an apparatus according to one or more aspects of the invention.

FIG. 3 is a schematic of a torque sensor device 24 according to one or more aspects of the invention. Torque sensor device 24 depicted in FIG. 3 is capable of counting turns applied, acquiring the speed of rotation applied, and measuring torque applied from the top drive to the tubular threaded connection 9. Torque sensor device 24 may include a housing 26, sensor 28 (e.g., gauge) and a turn encoder 30. Sensor 28 may also measure (e.g., provide data associated with) the axial load at the location of sensor 28. Examples of suitable turn encoders are manufactured, for example, by BEI Technologies, Inc. and Hohner. Examples of sensors are manufactured for example by 3PS, Inc., Omron Scientific Technologies, Inc. and Honeywell.

Torque sensor device 24 is depicted in FIG. 3 connected to a tubular member, generally denoted by the numeral 32, having an axial bore 34. Tubular member 32 is described as a generic tubular member to represent the one or more locations at which torque sensor device 24 may be positioned. For example, and without limitation, tubular member 32 may comprise top drive 14 (for example quill 15), mandrel 12*a* of tubular running tool 12, and/or a tubular sub connected within system 10, e.g., connected between mandrel 12*a* of tubular running tool 12 and quill 15.

Figure 4:
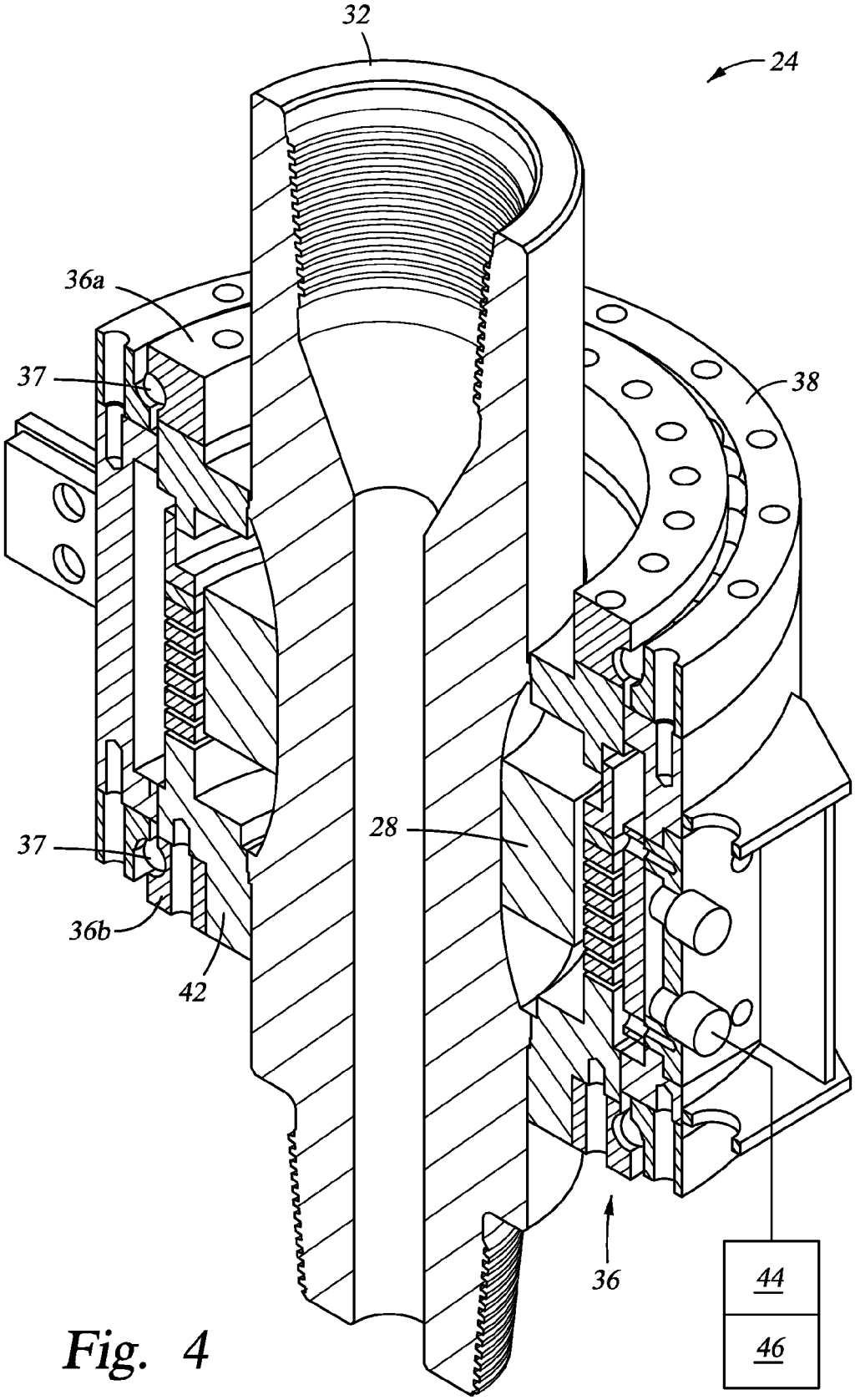
FIG. 4 is a sectional view of an embodiment of a torque sensor device according to one or more aspects of the invention.

FIG. 4 is schematic view of a torque sensor device 24 according to one or more aspects of the invention. Torque sensor device 24 includes a sensor 28 (e.g., transducer, Wheatstone bridge, piezoelectric strain gauge, semi-conductor gauge, etc.) that is connected with tubular member 32 (e.g., sub, top drive quill 15, tool mandrel 12*a*, etc.). Sensor 28 may be removably connected with tubular member 32 in various manners, such as, and without limitation to, clamping or securing two or more segments of sensor 28 together about tubular member 32. In the depicted embodiment, sensor 28 is disposed between opposing ends 36*a*, 36*b* (e.g., collars) of a frame 36 (e.g., slip ring, housing, body) which rotates in unison with sensor 28 and tubular member 32.

Torque sensor device 24 depicted in FIG. 4 also includes a housing 38 (e.g., external frame) that is rotationally disposed about frame 36 via bearings 37 so that frame 36 and housing 38 can rotate separate and independent of one another. For example, frame 36, gauge 28 can rotated in unison with tubular member 32 while housing 38 is held rotationally stationary as depicted for example in FIGS. 1 and 2. Referring to FIGS. 1 and 2, housing 38 is held rotationally stationary through the connection to stationary object 13 (e.g., top drive rail) via a member 40 and arrestor 23. It is noted that an external frame, such as housing 38, may be held rotationally stationary for one or more reasons including, without limitation, connecting hoses and/or wiring, and for connecting a load sensor for example as described below with reference to reaction torque measurement device 22. In some embodiments of the invention, housing 38 may be a rotating element as will be understood by those skilled in the art with benefit of this disclosure. For example, housing 38 may not necessarily be maintained rotationally stationary in embodiments utilizing wireless telemetry.

Transmission of data, e.g., from sensor 28 to controller 20 (FIG. 1), may be provided in various manners including wireless telemetry. Depicted in FIG. 4, a wireless telemetry package may include an antenna 42 (e.g., loop antenna), power supply 44 and RF receiver 46 for receiving output from sensors 28.

Figure 5:
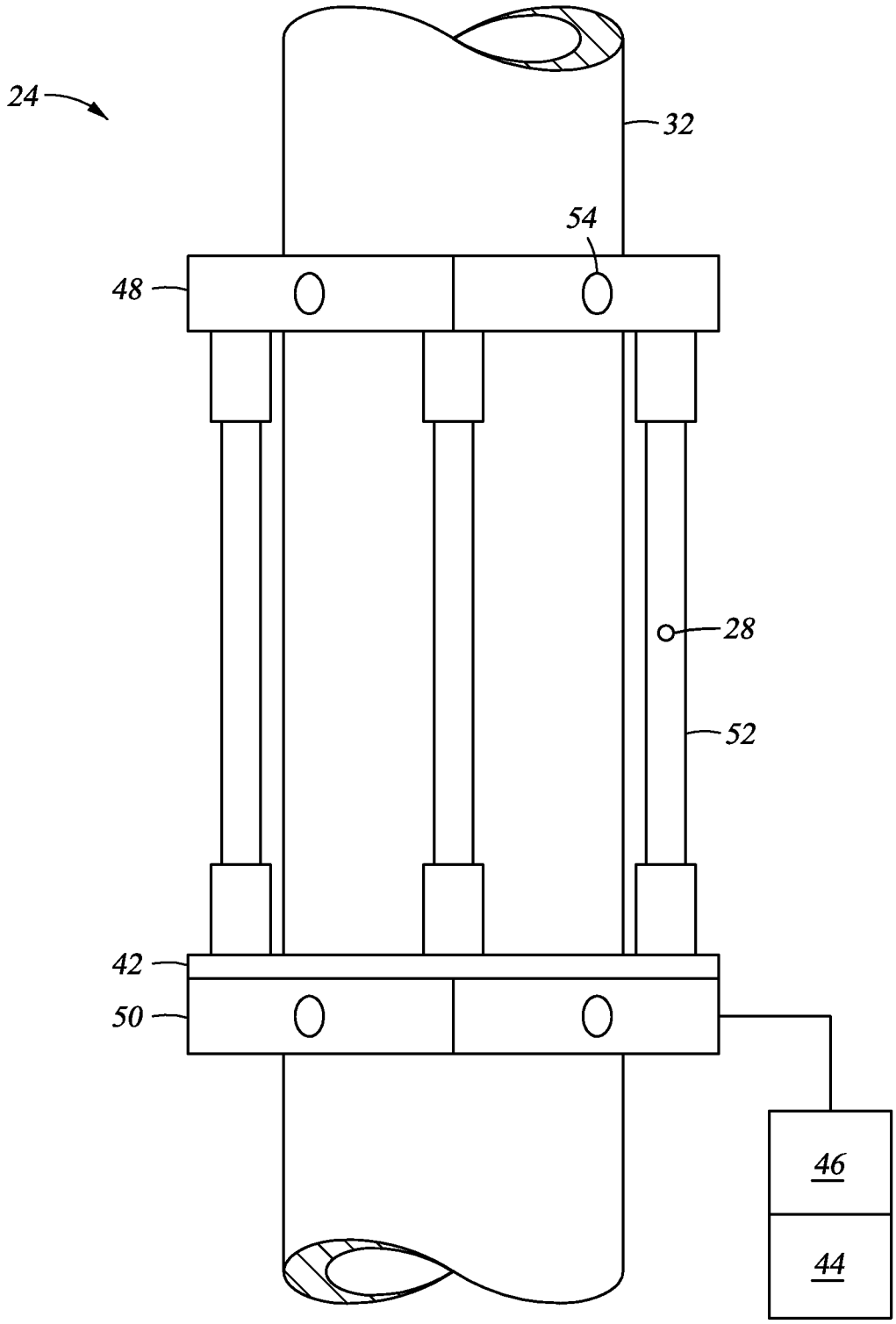
FIG. 5 is a schematic view of another embodiment of a torque sensor device according to one or more aspects of the invention.

FIG. 5 is a schematic view of another embodiment of a torque sensor device 24 according to one or more aspects of the invention. Torque sensor device 24 is removably connected with tubular member 32. Torque sensor device 24 depicted in FIG. 5 comprises a first collar 48 and a second collar 50 spaced apart from one another and interconnected by a bending beam 52 and sensor(s) 28. Sensor 28, depicted in FIG. 5, is a strain gauge. Each collar 48, 50 may be divided (e.g., radially) into two or more segments for attaching to tubular member 32, for example by bolts 54. The depicted wireless telemetry package is induction powered by a loop antenna 42 coupled to a power supply 44 and RF receiver 46 for receiving output from sensors 28. The angular displacement generated between collars 48, 50 is associated with dimensions of tubular member 32 and the distance between collars 48, 50. The angular displacement is proportional to the torque applied. Sensors 28 may also provide data associated with the axial load applied at tubular member 32. An example of a torque sensor device that may be utilized, at least in part, is a "Clamp on Rotary Torque Transducer" provided by Honeywell. Collars 48, 50, sensors 28 and bending beam 52 may be configured as an inner frame such as depicted in FIG. 4.

The embodiments of torque sensor device 24 depicted in FIGS. 4 and 5 are particularly adapted to be removed from member 32. The removable functionality of torque sensor device 24 may satisfy one or more of the aspects of allowing for attachment of torque sensor device 24 directly with top drive 14 (e.g., the quill) or tool 12 as opposed to requiring a dedicated sub; removal of torque sensor device 24 so that underlying tubular member (e.g., tubular member 32) may be tested for structural integrity as is necessary from time to time; and provide for ease in replacing a member such as sensor 28 or tubular member 32 thereby reducing lost rig time. Further, torque sensor device 24 may be removed (e.g., detached) during certain operations to protect the delicate sensor.

Figure 6:
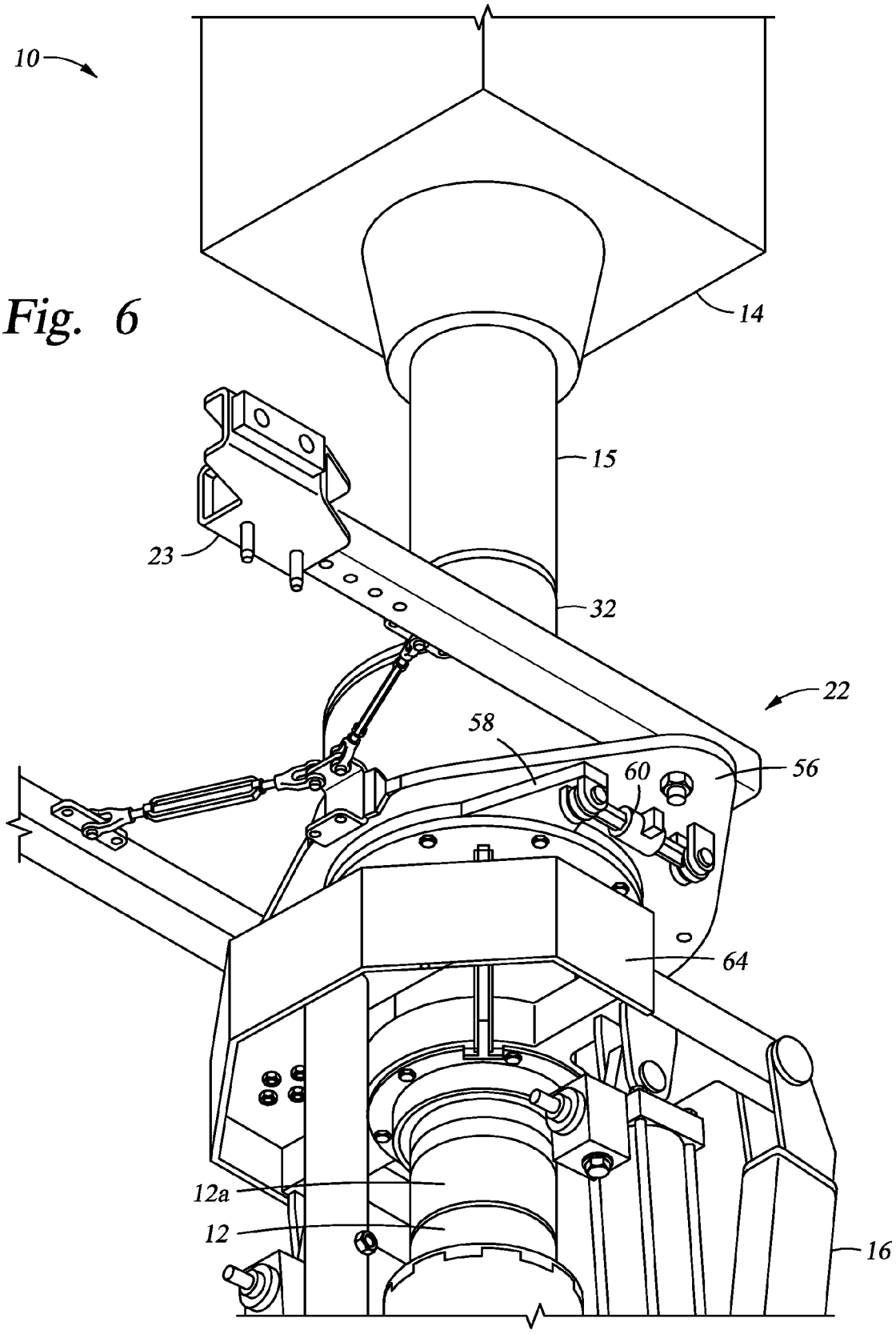
FIG. 6 is an expanded view of a section of a tubular running tool system depicting an embodiment of a reaction torque measuring apparatus according to one or more aspects of the invention.
Figure 7:
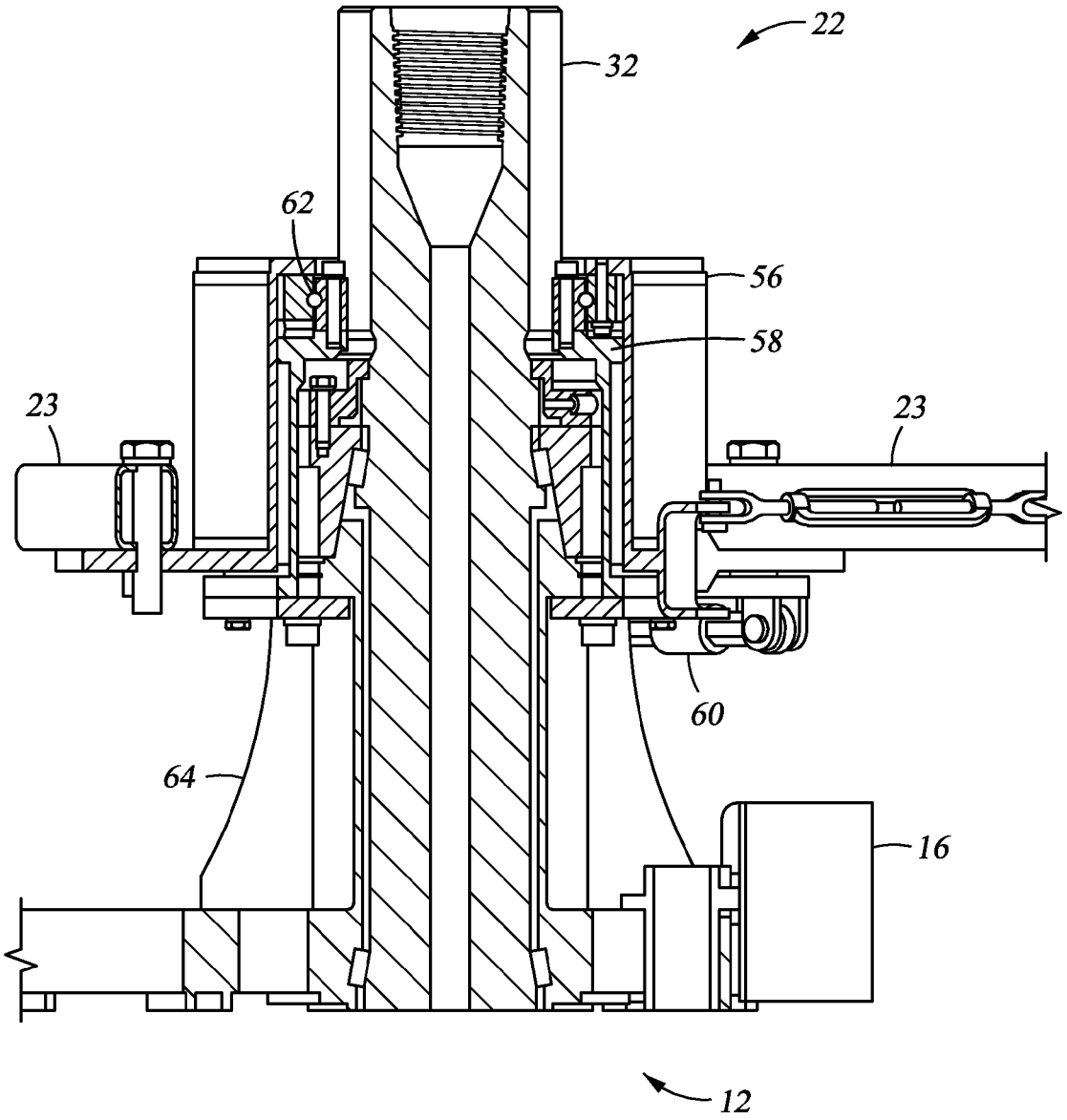
FIG. 7 is a sectional view of a reaction torque measuring apparatus according to one or more aspects of the invention.

FIGS. 6 and 7 are schematic views of a portion of wellbore tubular running system 10 depicting a reaction load device 22 according to one or more aspects of the invention. Reaction load device 22, depicted in FIGS. 6 and 7, is now described with reference to FIGS. 1 and 2. An arrestor 23 may be provided to arrest the rotation of selected rotational elements of tubular running tool 12. Rotational elements of tubular running tool 12, are elements that are rotationally mounted, e.g., via bearings, relative to mandrel 12*a* so that the rotational element is urged (e.g., tends) to rotate with mandrel 12*a* in response to the rotation and torque applied from top drive 14 to tubular 5. For example, arrestor 23 (depicted as arms) is connected between a rotationally stationary object 13 (e.g., a top drive rail in FIGS. 1 and 2, top drive bail ears, etc.) and one or more rotational elements, such as, tubular manipulator 16, which is urged to rotate in response to the rotation applied by the top drive. Depicted in FIGS. 1, 2, 6 and 7, reaction load device 22 is connected to arrestor 23 to measure (e.g., sense) the reaction torque (e.g., drag torque, drag force) applied to arrest the rotation of the rotational element. According to one embodiment, a true torque measurement of the torque applied for example to the thread connection 9 (FIGS. 1 and 2) may be determined utilizing the drag torque measurement of reaction load device 22 and the torque measurement acquired by torque sensor device 24. For example, in one embodiment, subtracting the measured drag torque from the torque measurement at device 24 identifies the actual torque that is applied at thread connection 9.

Reaction load device 22, depicted in FIGS. 6 and 7, comprises a first (e.g., reaction) housing 56, a second (e.g., or torque) housing 58, and a load sensor 60 (e.g., load cell, transducer, gauge, etc.). In the depicted embodiment, first housing 56 and second housing 58 are rotationally connected to one another via bearing assembly 62 and each is rotationally connected to the rotating mandrel of running tool 12. First housing 56 is held substantially rotationally stationary via arrestor 23, which is connected rotationally to rotationally stationary object 13 (e.g., rails, bail ears, a chain, etc.). Second housing 58 is connected with a member 64 of running tool 12 in the depicted example. Member 64 depicted in FIGS. 6 and 7 is a frame that is connected to manipulator 16 and rotationally connected with tubular member 32. Being rotationally connected with tubular member 32, frame 64 and thus second housing 58 are urged to rotate with tubular member 32 unless the rotational elements are held stationary, for example via arrestor 23. For purposes of clarity, tubular member 32 is described as being connected to or with top drive 14 and may be, for example, a portion of top drive quill 15, a portion of mandrel 12*a* of tool 12, or a sub member that is in connection with top drive 14. Tubular member 32, manipulator 16 and member 64 are urged to rotate in unison when torque and rotation are applied from top drive 14 (FIG. 1). Depicted first tubular housing 56 is held rotationally stationary via arrestor 23. Without load sensor 60 connected, the rotational elements, e.g., member 64, second housing 58 and manipulator 16 tend (e.g., are urged) to rotate with tubular member 32. The connection of load sensor 60 between first housing 56 and second housing 58 rotationally locks housings 56, 58 relative to one another and further arrests rotation of the connected manipulator 16 in the depicted example. Thus, load sensor 60 acquires a measurement of the reaction torque (e.g., drag torque, load, force) applied to arrest the rotation of rotational elements of tubular running tool 12.

A method of operating system 10, referred to generally as an interlock system, according to one or more aspects of the invention is now described with reference to FIGS. 1-7. Controller 20 may be utilized to operate, for example, spider 7, tubular running tool 12, single joint elevator, manipulator 16 and/or other operational devices, systems and sub-systems of running system 10. In general, interlock system 10 ensures that tubular 5 (including first tubular 5*a* and second tubular 5*b*) are always supported. For example, in one embodiment the interlock system ensures that at least one of the spider 7 and the tubular running tool 12 supports tubular 5 (e.g., a tubular string) before releasing the other of the spider and the tubular running tool from supporting tubular 5. For example, system 10 may ensure via visual displays, operational control locks, interlocks to ensure that add-on tubular 5*a* is supported by tubular running tool 12 prior to the elevator (e.g., manipulator 16) releasing gripping support of tubular 5*a*. For example, as described above with reference to various embodiments of torque sensor device 24, sensor 28 can measure an axial load at tubular member 32. Thus, monitoring the axial load on tubular member 32 may indicate if the weight of add-on tubular 5*a*, for example, is supported by manipulator 16, running tool 12, or by spider 7. In response to axial load data, controller 20 may block operation of manipulator 16 to release add-on tubular 5*a* for example.

The foregoing outlines features of several embodiments so that those skilled in the art may better understand the aspects of the invention. Those skilled in the art should appreciate that they may readily use the depicted embodiments as a basis for designing or modifying other processes and structures for carrying out the same purposes and/or achieving the same advantages of the invention introduced herein. Those skilled in the art should also realize that such equivalent constructions do not depart from the spirit and scope of the invention, and that they may make various changes, substitutions and alterations herein without departing from the spirit and scope of the invention.

What is claimed is:

1. A wellbore tubular running system, the system comprising:

a top drive operable to rotate a tubular;

a tubular running tool connecting the top drive and the tubular;

a first sensor connected to a tubular member to measure a torque applied from the top drive to the tubular;

a load sensor connected with the tubular running tool to measure a drag torque applied in response to the torque applied from the top drive; and a controller connected to the first sensor to receive the measured torque applied and connected to the load sensor to receive the measured drag torque applied, the controller determining an actual torque applied to the thread connection, wherein the actual torque applied is the measured torque applied reduced by the measured drag torque.

2. The system of claim 1, wherein the first sensor is capable of measuring an axial load.

3. The system of claim 1, wherein the tubular member comprises one selected from the top drive, a sub, and the tubular running tool.

4. The system of claim 1, wherein the first sensor is disposed between opposing collars removably connected to the tubular member.

5. The system of claim 4, wherein the first sensor comprises a bending beam connected between the opposing collars.

6. The system of claim 4, wherein the first sensor is capable of measuring an axial load.

7. The system of claim 6, wherein the first sensor comprises a bending beam connected between the opposing collars.

8. The system of claim 1, wherein the first sensor is removably connected to the tubular member.

9. The system of claim 1, wherein the load sensor is connected between a rotational element of the tubular running tool and a rotationally stationary object.

10. The system of claim 9, wherein the rotational element comprises a tubular manipulator.

11. The system of claim 10, wherein the tubular manipulator comprises a single joint manipulator arm.

12. The system of claim 9, wherein the rotationally stationary object comprises a top drive rail.

13. A method for assembling and/or disassembling a tubular string formed of a first tubular and a second tubular, comprising:

engaging the first tubular with a first device;

engaging the second tubular with a second device;

connecting the first tubular to the second tubular at a thread connection by applying torque to the first tubular;

measuring the torque applied to the first tubular;

measuring a drag torque associated with the torque applied to the first tubular;

reducing the measured torque applied by the measured drag torque to determine an actual torque applied to the thread connection;

ensuring that at least the first device or the second device is supporting the tubular string;

disengaging the second device from the tubular string; and lowering the tubular string.

14. The method of claim 13, wherein the first device is a top drive and the second device is a spider.

15. The method of claim 14, wherein the top drive comprises a tubular running tool.

16. The method of claim 14, wherein the top drive comprises a tubular running tool and an elevator.

17. The method of claim 14, wherein the measuring the torque applied comprises removably disposing a first sensor with the top drive.

18. The method of claim 17, further comprising measuring an axial load via the first sensor.

19. The method of claim 13, wherein the first device comprises a top drive and the measuring the torque applied comprises:

removably connecting opposing collars with a tubular member connected with the top drive; and providing a first sensor with the opposing collars.

20. The method of claim 19, further comprising measuring an axial load via the first sensor.

21. The method of claim 19, wherein the top drive comprises a tubular running tool.

22. The method of claim 13, wherein the first device comprises a top drive and the measuring the torque applied comprises:

removably connecting opposing collars to a tubular member connected with the top drive;

providing a first sensor with the opposing collars; and providing a bending beam between the opposing collars.

23. The method of claim 22, further comprising measuring an axial load via the first sensor.

24. The method of claim 22, wherein the top drive comprises a tubular running tool.

* * * * *